United States Patent [19]

Yamazaki et al.

[11] Patent Number: 4,710,349

[45] Date of Patent: Dec. 1, 1987

[54] HIGHLY CONDUCTIVE COPPER-BASED ALLOY

[75] Inventors: Shinsuke Yamazaki, Ichikawa; Rikio Takeda, Koganei; Iwao Uda, Sakai, all of Japan

[73] Assignee: Sumitomo Metal & Mining Co., Ltd., Tokyo, Japan

[21] Appl. No.: 22,377

[22] Filed: Mar. 5, 1987

[30] Foreign Application Priority Data

Mar. 18, 1986 [JP] Japan ..... 61-58024

[51] Int. Cl.[4] ..... C22C 9/00

[52] U.S. Cl. ..... 420/495; 420/496; 420/499; 420/500

[58] Field of Search ..... 420/495, 496, 499, 500

[56] References Cited

FOREIGN PATENT DOCUMENTS

| | | | |
|---|---|---|---|
| 49-33823 | 3/1974 | Japan . | |
| 49-46518 | 5/1974 | Japan . | |
| 52-12621 | 1/1977 | Japan . | |
| 55-11145 | 1/1980 | Japan . | |
| 55-47337 | 4/1980 | Japan . | |
| 104447 | 8/1980 | Japan | 420/496 |
| 57-5834 | 1/1982 | Japan . | |
| 57-39146 | 3/1982 | Japan . | |
| 58-123746 | 7/1983 | Japan . | |
| 58-210140 | 12/1983 | Japan . | |
| 59-126740 | 7/1984 | Japan . | |
| 59-140341 | 8/1984 | Japan . | |
| 59-140342 | 8/1984 | Japan . | |
| 59-193233 | 11/1984 | Japan . | |
| 59-222543 | 12/1984 | Japan . | |
| 60-194030 | 10/1985 | Japan . | |
| 60-194031 | 10/1985 | Japan . | |
| 61-99642 | 5/1986 | Japan . | |
| 61-99643 | 5/1986 | Japan . | |

*Primary Examiner*—L. Dewayne Rutledge
*Assistant Examiner*—George Wyszomierski
*Attorney, Agent, or Firm*—Hedman, Gibson, Costigan & Hoare

[57] ABSTRACT

A highly conductive copper-based alloy containing 0.001 percent to 0.02 percent of tellurium, 0.05 percent to 0.3 percent of one element selected from iron and chromium, and 0 percent to 0.01 percent of phosphorous with the balance being copper and incidental impurities.

2 Claims, No Drawings

HIGHLY CONDUCTIVE COPPER-BASED ALLOY

BACKGROUND OF THE INVENTION

1. Field of the Invention

The present invention relates to a copper-based alloy with high conductivity, which is suitable for use in semiconductor lead frames, automobile radiator fins, and the like.

2. Description of the Related Art

Oxygen-free copper, phosphorous deoxidized copper, and an alloy of copper with 1% by weight of tin, which are widely known conventionally, have superior electrical conductivity and heat radiation properties. However, if these materials are heated to 250° C. to 380° C., they tend to soften so that during the assembly of semiconductor devices, the solder coating treatment of radiators, and similar processes, softening and heat distortion occur easily. Also, the materials have a tensile strength as low as about 40 kg/mm$^2$. Accordingly, there are severe limitations in the manufacture of such materials, and, in addition, it is not possible to obtain satisfactory performance at time of use.

Lead frames for use in power transistors, in which a flowing electrical current reaches several amperes, require a conductivity in excess of 85% IACS as well as good heat radiation properties. Further, when assembling semiconductor devices at a temperature from 300° C. to 450° C., it requires the heat resistance so that heat distortion and softening are avoided. It is also necessary that the mechanical strength be such that it is difficult to produce abnormal deformation when shipping and assembling semiconductor parts. Also, because of continuing efforts to reduce the size of equipment, there is, in recent years, a trend toward thinner and thinner thicknesses and better heat radiation for fins used on automobile radiators. Accordingly, there is a need for the development of a material with a high mechanical strength to avoid the occurrence of breakage and deformation caused by handling of the material.

SUMMARY OF THE INVENTION

An object of the present invention is to provide, with due consideration to the drawbacks of such conventional devices, a material wherein softening and heat distortion in the assembly of semiconductor devices and during the solder coating treatment of radiators is restrained to improve productivity.

Another object of the present invention is to provide a highly conductive copper-based alloy consisting of, by weight, 0.001% to 0.02% of tellurium, 0.05% to 0.3% of one element selected from the group consisting of iron and chromium, and 0% to 0.01% of phosphorous with the balance being copper and incidental impurities.

DETAILED DESCRIPTION OF THE INVENTION

The alloys of compositions listed in Table 1 (in weight percentages) were prepared in the following manner. Commercial electrolytic copper was melted using a high frequency, air melting furnace with a graphite crusible therein and immediately after melting the molten surface was covered with a charcoal-type flux. Next, tellurium was added at the values shown in Table 1 in the form of an alloy of copper with 50% tellurium by weight. Then iron or chromium was added at the values shown in Table 1; wherein the iron was added in the form of thin plate piece; and the chromium was in the form of an alloy of copper with 10% by weight of chromium. In addition, phosphorous was added in the values shown in Table 1 in the form of an alloy or copper with 15% by weight of phosphorous. After the melting was completed, the alloy was cast into molds, resulting in ingots 105 mm wide, 35 mm thick, and 210 mm long. After 5 mm was pared or faced from both the width and the thickness, the ingots were heated to 900° C., hot-rolled to a plate thickness of 13 mm, and water-cooled. One millimeter was pared or faced from both surfaces of the hot-rolled material, after which the material was cold-rolled to a plate thickness of 0.6 mm. The alloy was then heat-treated for one-hour at 450° C. in an atmosphere of argon gas stream. Next, the plate was cold-rolled to a thickness of 0.25 mm and annealed for one hour at 300° C. in argon gas stream. Measurements were made on the resulting plate for tensile strength, hardness, conductivity, and half-softening temperature (an indication of heat resistance).

The measurement of the half-softening temperature was performed by determining the temperature to which the material must be heated to reach a tensile strength of 80% of the tensile strength before heating (with heating time 60 min). The composition of the alloys and the results of these measurements are shown in Table 1. The upper section of Table 1 gives alloys (No. 1 to No. 14) of the present invention, while the bottom section shows alloys (No. 15 to No. 25) adjusted for reference purposes.

TABLE 1

| Test | Components by wt. % | | | | | Conductivity | Tensile strength | Half-soft temperature | Vickers hardness | Hot |
|---|---|---|---|---|---|---|---|---|---|---|
| No. | Te | Cr | Fe | P | Cu | (% IACS) | (Kg/mm$^2$) | (°C.) | (1 Kg Load) | processibility |
| 1 | 0.002 | 0.06 | — | — | balance | 92 | 42 | 400 | 130 | Good |
| 2 | 0.010 | 0.11 | — | — | " | 90 | 45 | 420 | 135 | " |
| 3 | 0.015 | 0.09 | — | — | " | 91 | 44 | 430 | 131 | " |
| 4 | 0.011 | 0.24 | — | — | " | 88 | 47 | 460 | 140 | " |
| 5 | 0.003 | — | 0.08 | — | " | 93 | 41 | 400 | 130 | " |
| 6 | 0.005 | — | 0.12 | — | " | 91 | 44 | 410 | 130 | " |
| 7 | 0.016 | — | 0.27 | — | " | 89 | 46 | 450 | 137 | " |
| 8 | 0.013 | — | 0.15 | — | " | 90 | 44 | 430 | 133 | " |
| 9 | 0.003 | 0.07 | — | 0.002 | " | 90 | 42 | 410 | 130 | " |
| 10 | 0.006 | 0.08 | — | 0.010 | " | 87 | 43 | 430 | 132 | " |
| 11 | 0.010 | 0.19 | — | 0.005 | " | 86 | 47 | 460 | 141 | " |
| 12 | 0.003 | — | 0.06 | 0.008 | " | 87 | 40 | 440 | 133 | " |
| 13 | 0.008 | — | 0.11 | 0.004 | " | 86 | 43 | 450 | 134 | " |
| 14 | 0.018 | — | 0.28 | 0.006 | " | 85 | 46 | 470 | 138 | " |
| 15 | 0.005 | 0.03 | — | — | " | 95 | 36 | 360 | 123 | " |
| 16 | 0.011 | 0.04 | — | — | " | 93 | 36 | 380 | 126 | " |

TABLE 1-continued

| Test No. | Components by wt. % Te | Cr | Fe | P | Cu | Conductivity (% IACS) | Tensile strength (Kg/mm$^2$) | Half-soft temperature (°C.) | Vickers hardness (1 Kg Load) | Hot processibility |
|---|---|---|---|---|---|---|---|---|---|---|
| 17 | 0.016 | — | — | — | " | 93 | 35 | 370 | 122 | " |
| 18 | 0.025 | 0.10 | — | — | " | 90 | 44 | 420 | 135 | Cracks |
| 19 | 0.013 | 0.33 | — | — | " | 84 | 48 | 480 | 142 | Good |
| 20 | — | 0.22 | — | — | " | 89 | 43 | 390 | 131 | " |
| 21 | 0.012 | — | 0.03 | — | " | 92 | 35 | 350 | 124 | " |
| 22 | — | — | 0.18 | — | " | 90 | 40 | 390 | 127 | " |
| 23 | 0.014 | — | 0.34 | — | " | 83 | 47 | 420 | 135 | " |
| 24 | 0.011 | 0.14 | — | 0.015 | " | 84 | 44 | 430 | 140 | " |
| 25 | 0.013 | — | 0.16 | 0.017 | " | 82 | 46 | 440 | 140 | " |

As shown in Table 1, the alloys prepared within the composition ranges of the present invention have conductivities of 85% IACS or over, half-softening temperatures of 400° C. or over, and tensile strengths of 40 kg/mm$^2$ or over. This material has superior characteristics for application in semiconductor lead frames and fins for automobile radiators.

As can be clearly seen from Table 1, the present invention provides in the first embodiment or group a highly conductive alloy consisting of, by weight, 0.001% to 0.02% of tellurium and 0.05% to 0.3% of one element selected from the group of iron and chromium, with the balance being copper and incidental impurities, and also in the second embodiment or group a highly conductive alloy consisting of, by weight, 0.001% to 0.02% of tellurium, 0.05% to 0.3% of one element selected from the group of iron and chromium, and 0.001% to 0.01% phosphorous, with the balance being copper and incidental impurities.

The reason for the tellurium content being in the range of 0.001% to 0.02% by weight is that with a tellurium content of less than 0.001% by weight no improvement is seen in the heat resistance, and, if the content exceeds 0.02% by weight, then not only does the effect of the improvement in heat resistance appear to have reached a peak, but its hot processibility deteriorates, so that during hot-rolling many cracks appear in the material.

The reason for the iron or chromium content being in the range of 0.05% to 0.3% is that, with an iron or chromium content of less than 0.05% by weight, no improvement is seen in the mechanical strength and heat resistance, and, if the content exceeds 0.3% by weight, then, although the mechanical strength and heat resistance are improved, the conductivity does not reach the 85% IACS level.

The second embodiment of the alloy of the present invention, in which more than 0.001% phosphorous is added, is seen to have a higher heat resistance than the first embodiment. On this point, the material having phosphorus less than 0.001% by weight had superior heat resistance when compared with alloys No. 20 and 22 listed as reference alloys in Table 1 and was observed to be substantially the same as the alloys of the first embodiment of the present invention from the aspect of heat resistance.

Accordingly, it should be noticed that when the phosphorous content by weight exceeds 0.001%, an improvement in heat resistance is shown. For the alloys shown in Table 1, this can be easily understood by comparing alloy No. 2 containing no phosphorous with alloy No. 9 containing phosphorous, and by comparing alloy No. 5 containing no phosphorous with alloy No. 12 containing phosphorous. In these materials, although the conductivity is reduced with phosphorous contained, if the phosphorous content does not exceed 0.01% by weight, it is possible to ensure a required conductivity exceeding 85% IACS. In materials in which the phosphorous content exceeds 0.01% by weight, the effect of the improvement in the heat resistance has reached a peak, and it is not possible to reach the desired conductivity of 85% IACS.

Both the alloys of the present invention were obtained by melting commercial electrolytic copper with the addition of required tellurium, iron, chromium, phosphorous, respectively in the form of for example, an alloy of copper with 50% tellurium by weight, a thin plate piece of iron, a copper based alloy with 10% by weight of chromium, and a copper based alloy with 15% by weight of phosphorous, after which the material in the form of ingots was hot-rolled at the required temperature, and then repeatedly cold-rolled and heated.

It should be added that, in a copper-based alloy having a similar composition except that iron and chromium are both present, problems were caused in the post-processing, probably because the two exist as a compound.

What is claimed is:

1. A highly conductive copper-based alloy consisting essentially of, by weight, 0.001% to 0.02% of tellurium, 0.05% to 0.3% of one element selected from the group consisting of iron and chromium, and 0% to 0.01% of phosphorous with the balance being copper and incidental impurities.

2. The highly conductive copper-based alloy of claim 1, wherein the amount of phosphorous is 0.001% to 0.01% by weight.

* * * * *